US012320217B2

(12) United States Patent
Mlcak et al.

(10) Patent No.: US 12,320,217 B2
(45) Date of Patent: Jun. 3, 2025

(54) CUTTING DEVICE FOR WELLBORE CONTROL LINES

(71) Applicant: HALLIBURTON ENERGY SERVICES, INC., Houston, TX (US)

(72) Inventors: Matthew Craig Mlcak, Parker, TX (US); Joao Paulo Scudeler Vilela, The Woodlands, TX (US); Jason Paul Metzger, Joshua, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/406,372

(22) Filed: Jan. 8, 2024

(65) Prior Publication Data

US 2024/0392644 A1 Nov. 28, 2024

Related U.S. Application Data

(60) Provisional application No. 63/469,301, filed on May 26, 2023.

(51) Int. Cl.

| | |
|---|---|
| ***E21B 29/00*** | (2006.01) |
| ***E21B 29/02*** | (2006.01) |
| ***E21B 29/04*** | (2006.01) |
| ***E21B 43/11*** | (2006.01) |
| ***E21B 43/116*** | (2006.01) |

(52) U.S. Cl.

CPC ..... *E21B 29/002* (2013.01); *E21B 29/02* (2013.01); *E21B 29/04* (2013.01); *E21B 43/11* (2013.01); *E21B 43/116* (2013.01)

(58) Field of Classification Search

CPC ..... E21B 29/00; E21B 29/02; E21B 29/04; E21B 43/11; E21B 43/116; E21B 43/117

See application file for complete search history.

(56) References Cited

U.S. PATENT DOCUMENTS

| | | | | |
|---|---|---|---|---|
| 2001/0004016 | A1* | 6/2001 | Hillyer | E21B 23/0414 166/212 |
| 2016/0010415 | A1 | 1/2016 | Myhre et al. | |
| 2017/0037712 | A1 | 2/2017 | Davidson | |
| 2018/0142527 | A1* | 5/2018 | Stjern | E21B 33/14 |
| 2019/0003280 | A1* | 1/2019 | Witt | E21B 33/13 |
| 2019/0330962 | A1 | 10/2019 | Hardesty et al. | |
| 2020/0141213 | A1 | 5/2020 | Collier et al. | |

FOREIGN PATENT DOCUMENTS

| | | |
|---|---|---|
| CN | 203420687 U | 2/2014 |

OTHER PUBLICATIONS

International Search Report; dated May 8, 2024; PCT/US24/10636.

* cited by examiner

*Primary Examiner* — Brad Harcourt
(74) *Attorney, Agent, or Firm* — Polsinelli PC

(57) ABSTRACT

A cutting device includes a round of shots having a radial shape. Each shot in the round of shots are operable to perforate a wellbore conduit to sever one or more control lines. Each shot in the round of shots overlaps an adjacent shot in the round of shots by an overlap width that is equal to or greater than a width of the one or more control lines such that the round of shots maintains structural integrity of the wellbore conduit.

19 Claims, 6 Drawing Sheets

CUTTING DEVICE FOR WELLBORE CONTROL LINES

CROSS-REFERENCE TO RELATED APPLICATION

This application claims the benefit of U.S. Provisional Patent Application No. 63/469,301, filed in the U.S. Patent and Trademark Office on May 26, 2023, which is incorporated herein by reference in its entirety for all purposes.

FIELD

The present disclosure relates generally to cutting devices for wellbore control lines and/or flat packs.

BACKGROUND

Wellbores are drilled into the earth for a variety of purposes including tapping into hydrocarbon bearing formations to extract the hydrocarbons for use as fuel, lubricants, chemical production, and other purposes.

During completion of the wellbore, the annular space between the wellbore wall and a casing string (or casing) can be filled with cement. This process can be referred to as "cementing" the wellbore. After cementing comes completion phase where downhole completion equipment such as safety valves, plugs, packers, perforated or slotted liners, screens, slide door valves, tubular products, etc are run into the cased wellbore with tubing also known as production string. In order to control some of the downhole completion equipment, also known as lower completion, some control lines or flat packs are installed on the outside of the tubing in the anulus between the tubing and the casing. At the end life of a well, temporary or permanent plug is required to abandon the well. The well can be abandoned with the tubing string installed but it is required to be plugged with cement in the annular space between the casing and the tubing and inside the tubing.

BRIEF DESCRIPTION OF THE DRAWINGS

Implementations of the present technology will now be described, by way of example only, with reference to the attached figures, wherein.

DETAILED DESCRIPTION

Figure 1:
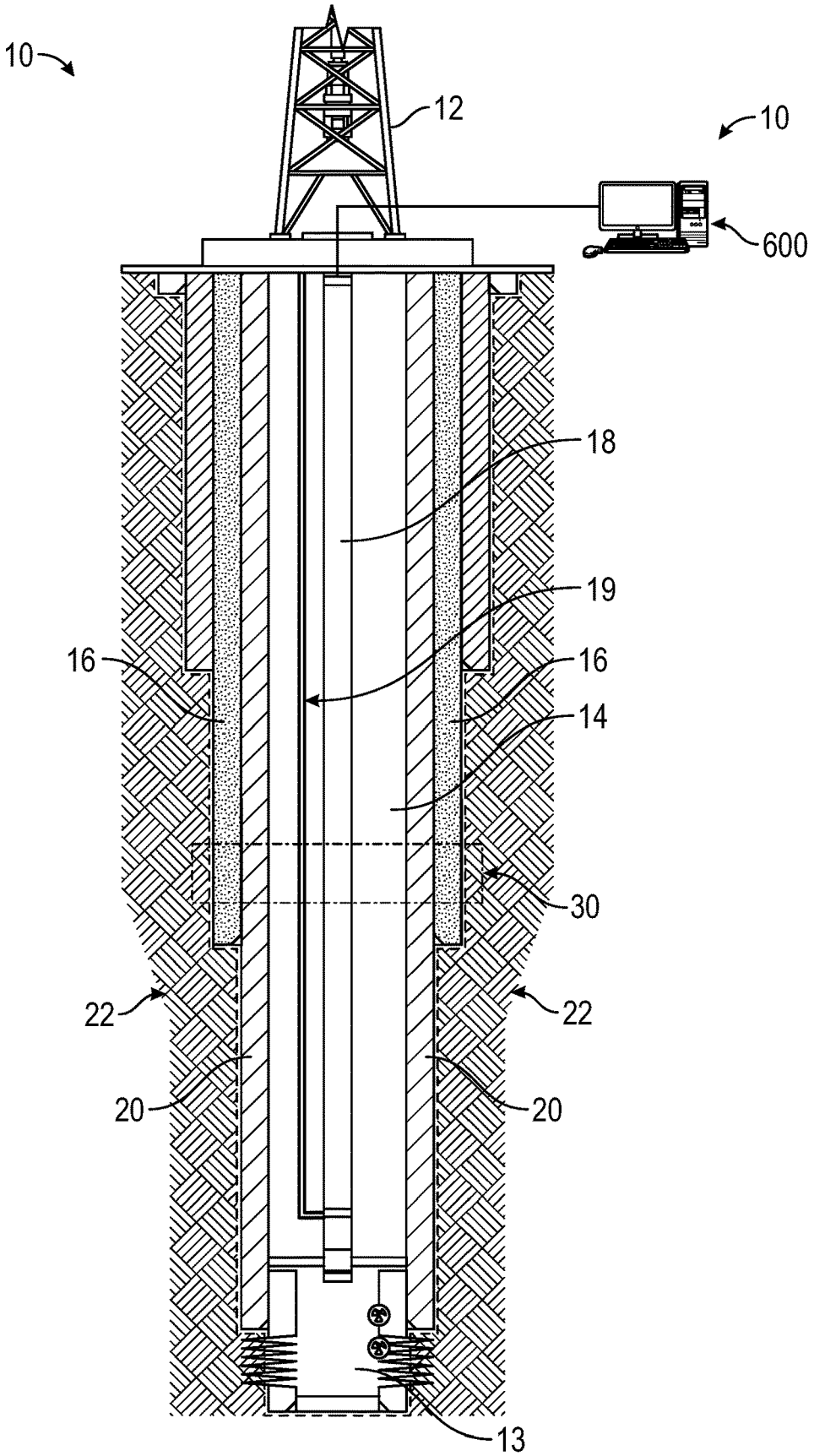
FIG. 1 illustrates a wellbore environment.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Before cementing the annulus in a wellbore, control lines on the outside of tubing in a wellbore need to be severed such that the control lines do not create gaps and/or other issues with the structural integrity of the cement. The control lines need to be severed without completely damaging the conduit (for example tubing) and putting the structural integrity of the conduit at risk. The exact position of the control line is often not known at a given depth since the control line position can be free to travel helically around the conduit when being installed.

As the position or location of the control line is often not known at a given depth, it can be difficult to sufficiently and fully sever the control lines without damaging the structural integrity of the conduit. It is known that over a short distance (for example less than 3 feet), the control line can be in a constant position.

While the present disclosure refers to control lines, in some examples, the control lines can be contained in and/or included with flat packs. When flat packs are involved, the cutting device should fully sever the one or more flat packs. For example, the wellbore system may include four flat packs and/or control lines. Accordingly, all flat packs and/or control lines around the conduit need to be fully severed.

A cutting device (for example a perforating gun) can have a multitude of shots that rotate around the axis of the gun at varying linear locations along the longitudinal axis. The charges can shoot outward covering a given angle making a hole that is elongated (e.g., substantially rectangular or oval) in shape and that minimizes the area of the cut of the conduit. The shots can be positioned in a spiral pattern over the longitudinal length of the cutting device to guarantee that the control line is severed. For example, the control line can be severed such that a span of the control line can fall into the wellbore away from the conduit.

Conventionally, the conduit may need to be removed to inject cement. In some examples, cementing or plugging the well can be completed with the conduit disposed in the wellbore. A conventional perforating gun may be run in the conduit. The perforating gun may punch holes in the conduit, and then cement can be run through the holes and fill the annulus inside the casing.

Conventional cutting systems use standard shape charges that are narrower and more targeted in the damage to the conduit. This makes it more difficult to guarantee that the control line can be cleanly hit and fully severed.

Conventional cutting systems end up splitting the conduit apart such that the conduit cannot be utilized for cementing. Also, conventional cutting systems may not fully sever the control lines at different depths as the position of the control lines may be unknown. In some examples, conventional cutting systems may include the additional step of scanning for positioning of control lines. However, that requires extra time and work, and moreover, it can be difficult to accurately line up the charges with the control line which can lead to an uncut or only partially cut control line.

The present cutting device uses at least one round of shots (e.g., charges) to cover a broader area that can help to guarantee that the control line(s) can be hit and severed no matter the positioning of the control line(s). In at least one example, the shots can be radial style charges. In some examples, the shots can be linear shaped charges.

The shots do not create a single pointed jet, but rather a jet that comes out in more of a planar, elongated direction. This can create a hole in the conduit that is more of a rectangular or oval shape. The cutting device can deploy a multitude of these shots with shape charges in a spiraling pattern along the longitudinal axis of the cutting device.

In at least one example, the round of shots can be limited to a minimum of four shots if the shot can cover a 90 degree area of the conduit. Narrower charges can be utilized requiring larger number of charges in the cutting device. However, the charges must have an overlap with each other that has an overlap width greater than a width of the control lines (and/or the flatback).

Each shape charge can be positioned a linear (longitudinal) distance away from the previous adjacent charge allowing for adequate material to remain in the conduit to maintain structural integrity of the conduit. The length of the cutting device can be kept to shorter lengths to help guarantee that the control line is in a fixed point on the outer diameter of the conduit in that length. This can be critical so that the shots can hit and sever the control line(s). The spiral pattern of the shots in the cutting device can be repeated several times in the length of the cutting device to give redundancy in the cutting device.

Figure 3:
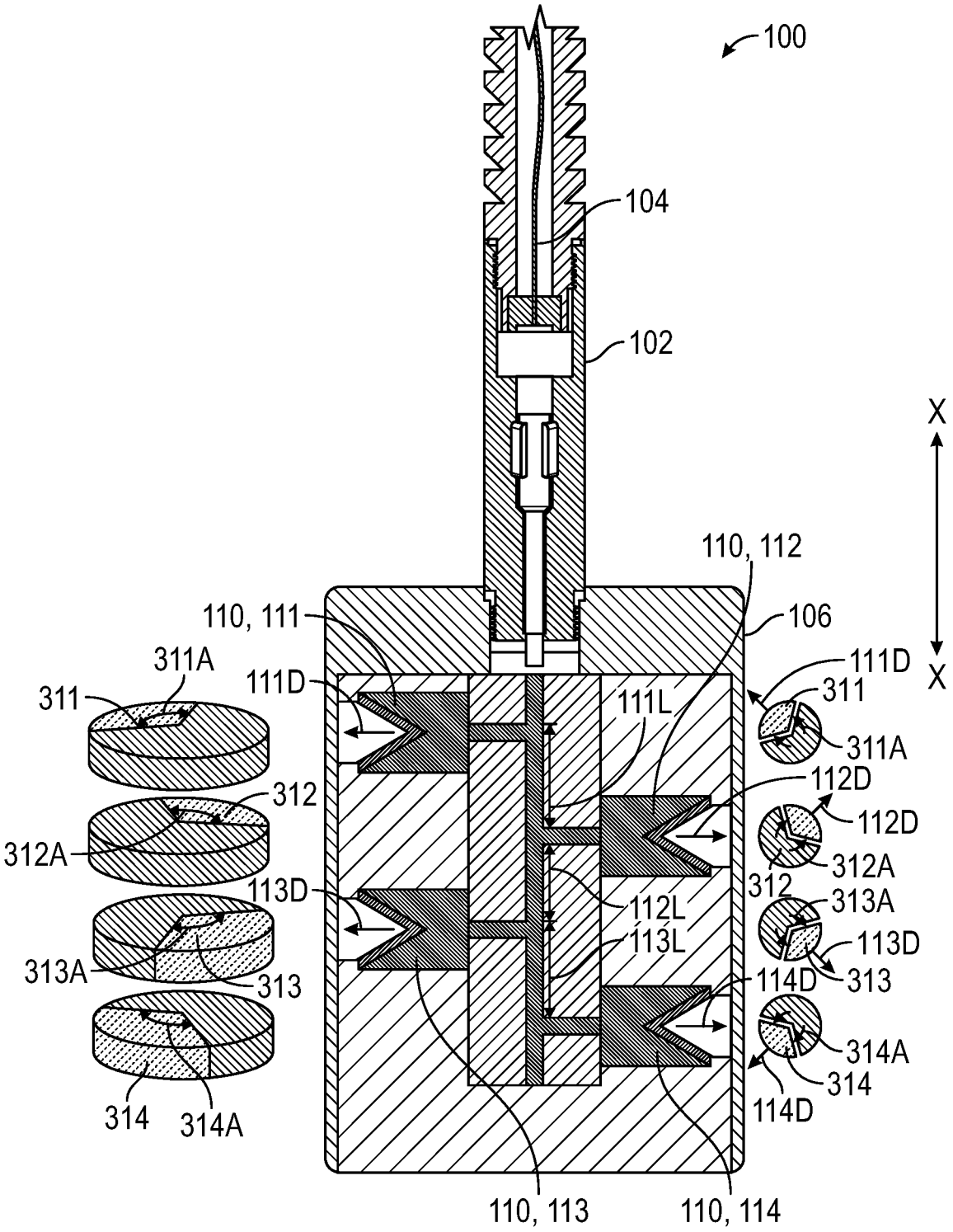
FIG. 3 illustrates a cutting device with a round of shots.

As illustrated by FIG. 1, the cutting device 100 (for example as shown in FIG. 3) can be employed in an exemplary wellbore environment 10. The environment 10 can include a drilling or workover rig 12 extending over and around a fluidic channel, such as a wellbore 14 in FIG. 1. In some examples, the environment 10 does not include a rig 12. The wellbore 14 is within an earth formation 22 and has a casing 20 lining the wellbore 14. The casing 20 can be held into place by cement 16.

A conduit 18 can be disposed within the wellbore 14. As illustrated, a wellbore annulus can be formed between the conduit 18 and the walls of the wellbore 14. In at least one example, the fluidic channel 14 can include the conduit 18. The conduit 18 can include, for example, tubing-conveyed, wireline, slickline, work string, joint tubing, jointed pipe, pipeline, coiled tubing, and/or any other suitable means for conveying a downhole device 13 into a fluidic channel 14 such as a wellbore 14. In some examples, the conduit 18 can include electrical and/or fiber optic cabling for carrying out communications. The conduit 18 can be sufficiently strong and flexible to tether the downhole device 13 through the wellbore 14, while also permitting communication through the conduit 18 to one or more of the processors, which can include local and/or remote processors. Moreover, power can be supplied via the conduit 18 to meet power requirements of the downhole device 13. For slickline or coiled tubing configurations, power can be supplied downhole with a battery or via a downhole generator.

It should be noted that while FIG. 1 generally depicts a land-based operation, the principles described herein are equally applicable to operations that employ floating or sea-based platforms and rigs, without departing from the scope of the disclosure. Also, even though FIG. 1 depicts a vertical wellbore, the present disclosure is equally well-suited for use in wellbores having other orientations, including horizontal wellbores, slanted wellbores, multilateral wellbores or the like.

Figure 2:
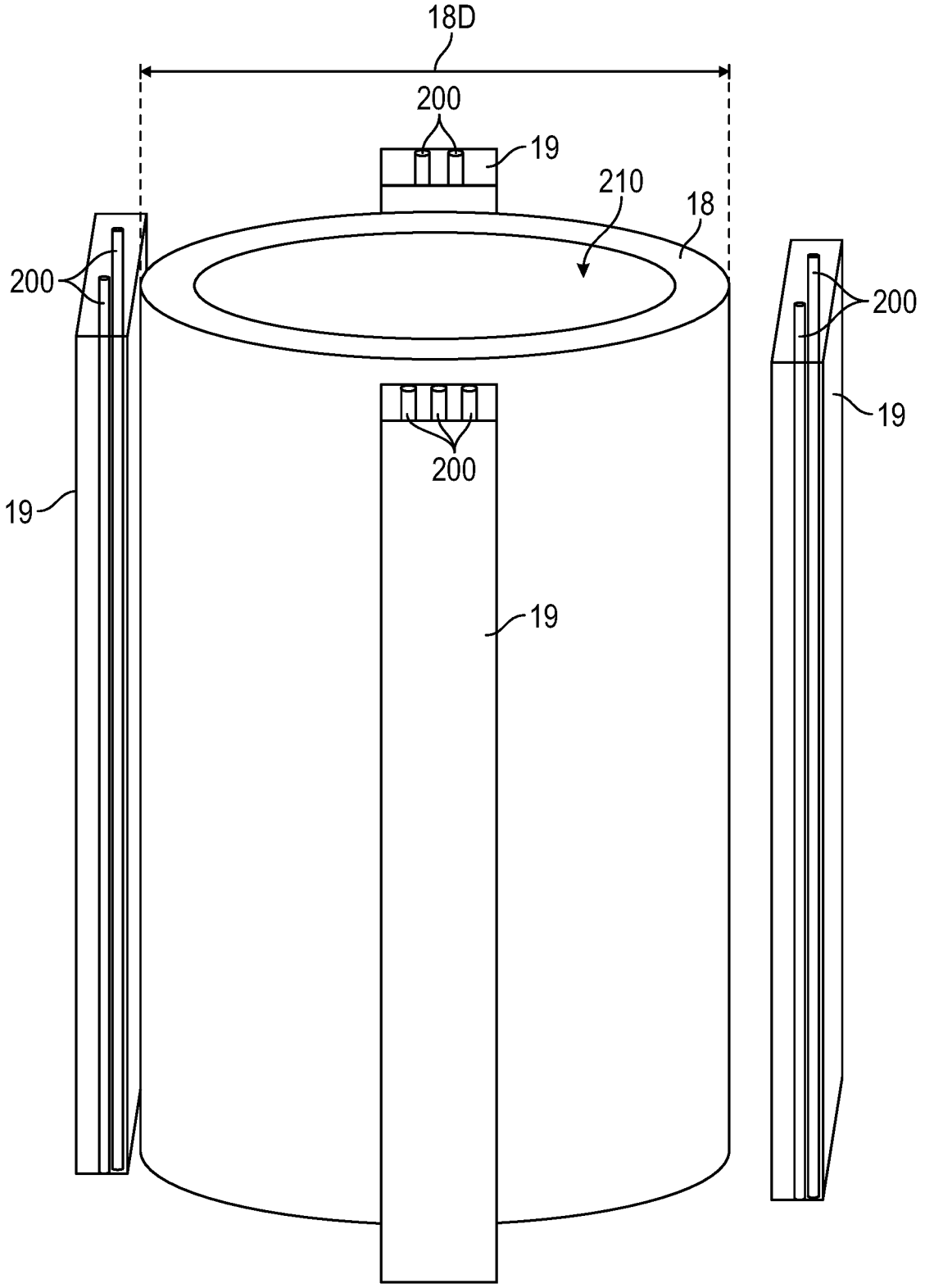
FIG. 2 illustrates a conduit with control lines.

One or more control lines (for example flatpacks) 19 can be disposed about the outside of the conduit 18. For example, as illustrated in FIG. 2, four control lines 19 can be disposed about the conduit 18. In some examples, the control lines 19 can be coupled with the conduit 18. In some examples, the control lines 19 can abut against the conduit 18. In some examples, the control lines 19 can be disposed in the wellbore 14 between the conduit 18 and the walls of the wellbore 14.

For some regulators, the control lines 19 must be severed and removed in a portion of the conduit 18 (for example, the area marked 30). In some examples, the portion 30 of the conduit 18 may be the location where a cement will be deployed. In some examples, depending on regulators and/or customers, a predetermined length of control lines 19 may need to be removed. For example, between about 20 meters and about 100 meters of control lines 19 may need to be removed. In some examples, between about 40 meters and about 80 meters of control lines 19 may need to be removed. In some examples, about 60 meters of control lines 19 may need to be removed.

In some examples, the control lines 19 can have dimensions of about 14 millimeters by about 36 millimeters.

FIG. 3 illustrates an example of a cutting device 100. The cutting device 100 can be disposed inside the conduit 18. In at least one example, the cutting device 100 can be translated within the conduit 18 via, for example, a wireline. The cutting device 100 can be operable to sever the control line(s) 19 disposed around the conduit 18 without damaging the structural integrity of the conduit 18.

The cutting device 100 can be operable to fully sever the control line(s) 19 with a single step. The cutting device 100 can include a round of four shots 110. For example, the cutting device 100 can include a first shot 111, a second shot 112, a third shot 113, and a fourth shot 114. The first shot 111 is adjacent to the second shot 112, the second shot 112 is adjacent the third shot 113, and the third shot 113 is adjacent the fourth shot 114. The shots 110 can include energetics, explosives, and/or charges.

The first shot 111 is operable to perforate through the wellbore conduit 18 in a first target direction 111D. The second shot 112 is operable to perforate through the wellbore conduit 18 in a second target direction 112D. The third shot 113 is operable to perforate through the wellbore conduit 18 in a third target direction 113D. The fourth shot 114 is operable to perforate through the wellbore conduit 18 in a fourth target direction 114D. In at least one example, for example where there are four shots 110, the first target direction 111D can be about 90 degrees offset from the second target direction 112D, the second target direction 112D can be about 90 degrees offset from the third target direction 113D, and the third target direction 113D can be about 90 degrees offset from the fourth target direction 114D. In at least one example, the first target direction 111D can be about 180 degrees offset from the third target direction 113D, and the second target direction 112D can be about 180 degrees offset from the fourth target direction 114D. Accordingly, the shots 110 are configured to evenly perforate the conduit 18 to better ensure that the control lines 19 are severed.

As illustrated in FIG. 3, each of the shots 110 can have a radial shape 311, 312, 313, 314 such that each shot 110 can perforate the wellbore conduit 18 along an apex angle 311A, 312A, 313A, 314A that corresponds with each shot 111, 112, 113, 114. For example, each shot 110 can cover an apex angle 311A, 312A, 313A, 314A of about 120 degrees about the conduit 18. Accordingly, four shots 110 covering apex angles 311A, 312A, 313A, 314A of about 120 degrees each can lead to about 30 degrees of overlap. The overlap of the shots 110 ensures that the control line(s) 19 are fully severed.

While the disclosure discusses four shots 110 and the corresponding angles and directions of the four shots 110, the angles and directions of the shots 110 can vary depending on the number of shots 110 provided in the round of shots 110 in the cutting device 100. For example, if there are three shots 110, the target directions may be about 120 degrees offset from one another, and the apex angles may be greater than 120 degrees so that there is sufficient overlap to fully sever the control lines 19. However, it is important to ensure that the shots 110 do not have such large apex angles so that the conduit 18 is split and rendered inoperable for cementing purposes.

As illustrated in FIG. 3, the first shot 111 can be positioned a first distance 111L away from the second shot 112 along a longitudinal direction X-X of the cutting device 100. The second shot 112 can be positioned a second distance 112L from the third shot 113 along the longitudinal direction X-X of the cutting device 100, and the third shot 113 can be positioned a third distance from the fourth shot 114 along the longitudinal direction X-X of the cutting device 100. Accordingly, the distances 111L, 112L, 113L between the shots 110 combined with the offset target directions 111D, 112D, 113D, 114D creates a cutting device 100 where each shot 110 is positioned in a spiral configuration along the longitudinal axis X-X of the cutting device 100. The first shot 111, the second shot 112, the third shot 113, and the fourth shot 114 can each be distanced from one another at least a predetermined distance 111L, 112L, 113L such that the round of shots 110 maintains structural integrity of the wellbore conduit 18 after perforating the wellbore conduit 18 while still fully severing the control lines 19, regardless of the location and position of the control lines 19. In some examples, each of the predetermined distances 111L, 112L, 113L can be less than one foot. In some examples, each of the predetermined distances 111L, 112L, 113L can be less than 6 inches.

In at least one example, the cutting device 100 can include a trigger to activate each of the shots 110. In some examples, the trigger can activate each shot 110 individually. In some examples, the trigger can activate a round of shots 110 simultaneously. The trigger can be an electrical trigger. For example, as illustrated in FIG. 3, a cutting conduit 102 can be coupled with the cutting device 100. The cutting conduit 102 can be communicably coupled with the trigger operable to activate each of the shots 110. The cutting conduit 102 can include a wireline that is operable to provide power and/or a signal to the electrical trigger to activate the shots 110 in the cutting device 100, for example when the cutting device 100 is positioned at the desired depth and/or location within the conduit 18.

Figure 4:
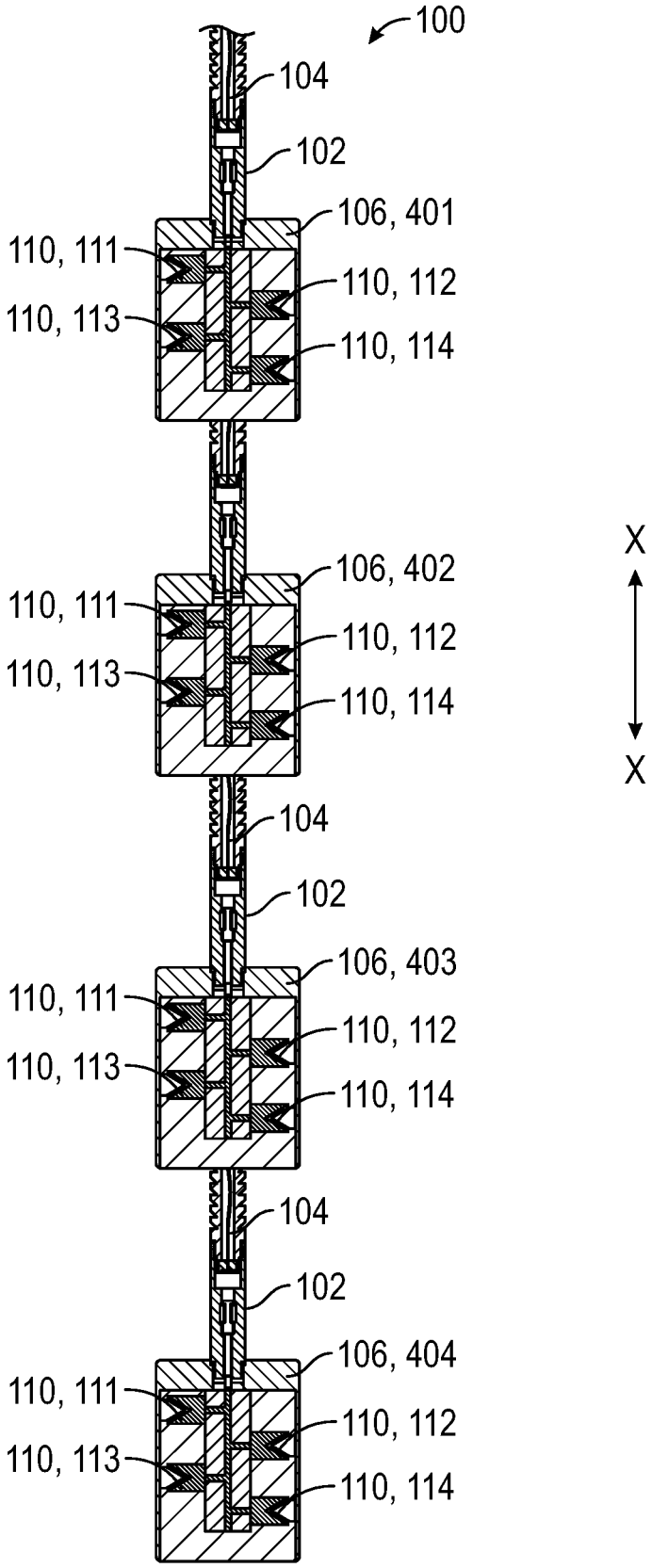
FIG. 4 illustrates a cutting device with a plurality of rounds of shots.

FIG. 4 illustrates a cutting device 100 with stacked rounds 106 of shots 110 where a plurality of rounds 106 of shots 110 are disposed along the longitudinal axis X-X of the cutting device 100. For example, the cutting device 100 can have a first round 401, a second round 402, a third round 403, and a fourth round 404 of shots 110. The second round 402 can be positioned down a distance from the first round 401 along the longitudinal axis X-X. The third round 403 can be positioned down a distance from the second round 402, and the fourth round 404 can be positioned down a distance from the third round 403. While FIG. 4 illustrates four rounds 106 of shots 110, in some examples, two, three, or more than four rounds 106 can be included in the cutting device 100. Each round of shots 110 can include a plurality of radial shots 110 (e.g., four) that have sufficient overlap to fully sever the control line(s) 19. Having a plurality of rounds 106 of shots 110 allows the cutting device 100 to sever the control line(s) 19 at different depths so ensure that the control line(s) 19 are discontinued and/or loose. Accordingly, the severed control lines 19 can be separated from the conduit 18 to not be present in the area for cementing. In some examples, the severed control lines 19 can fall into another depth of the wellbore 14.

In some examples, with the stacked rounds 106 of shots 110, as illustrated in FIG. 4, a single deployment and activation of the cutting device 100 can sever the control lines 19 at different depths, allowing for the control lines 19 to be separated from the conduit 18. Accordingly, only one run of the cutting device 100 may be needed.

In some examples, with multiple rounds 106 of shots 110 in the cutting device 100, the cutting device 100 can be utilized for selective fire. For example, the rounds 106 of shots 110 can be operable to be activated independently. Selective fire can include setting off a round 106 of shots 110 at one depth to cut the control lines 19 at that depth, and then the cutting device 100 can be moved within the conduit 18 to line up another round 106 of shots 110 at a second depth to cut the control lines 19 at the second depth. As illustrated in FIG. 4, four rounds 106 of shots 110 are stacked in the cutting device 100 along the longitudinal axis X-X. In some examples, one, two, three, or more than four rounds 106 of shots 110 can be included in the cutting device 100.

In at least one example, the cutting device 100 can include a trigger to activate each of the shots 110. In some examples, the trigger can activate each shot 110 individually. In some examples, the trigger can activate a round 106 of shots 110 simultaneously. The trigger can activate each round 106 of shots 110 at a time. In some examples, the trigger can be an electrical trigger. In at least one example, the trigger can be in communication with the controller 600. The controller 600 can provide instructions to the trigger to activate the shots 110 individually and/or together.

The wellbore operations can include perforating operations which can include the severing of the control lines 19, washing operations to clean out the wellbore 14, and then cementing operations. In some examples, washing operations can help push away the severed control lines 19.

Collars can be disposed along the longitudinal axis X-X of the conduit 18. Each collar can include clamps which hold the control lines 19 against the conduit 18. The control lines 19 can be cut a predetermined distance away from the collars to ensure that the control lines 19 are severed and separable from the conduit 18. In some examples, the predetermined distance can be at least one foot. In some examples, the predetermined distance can be at least one meter.

Figure 5:
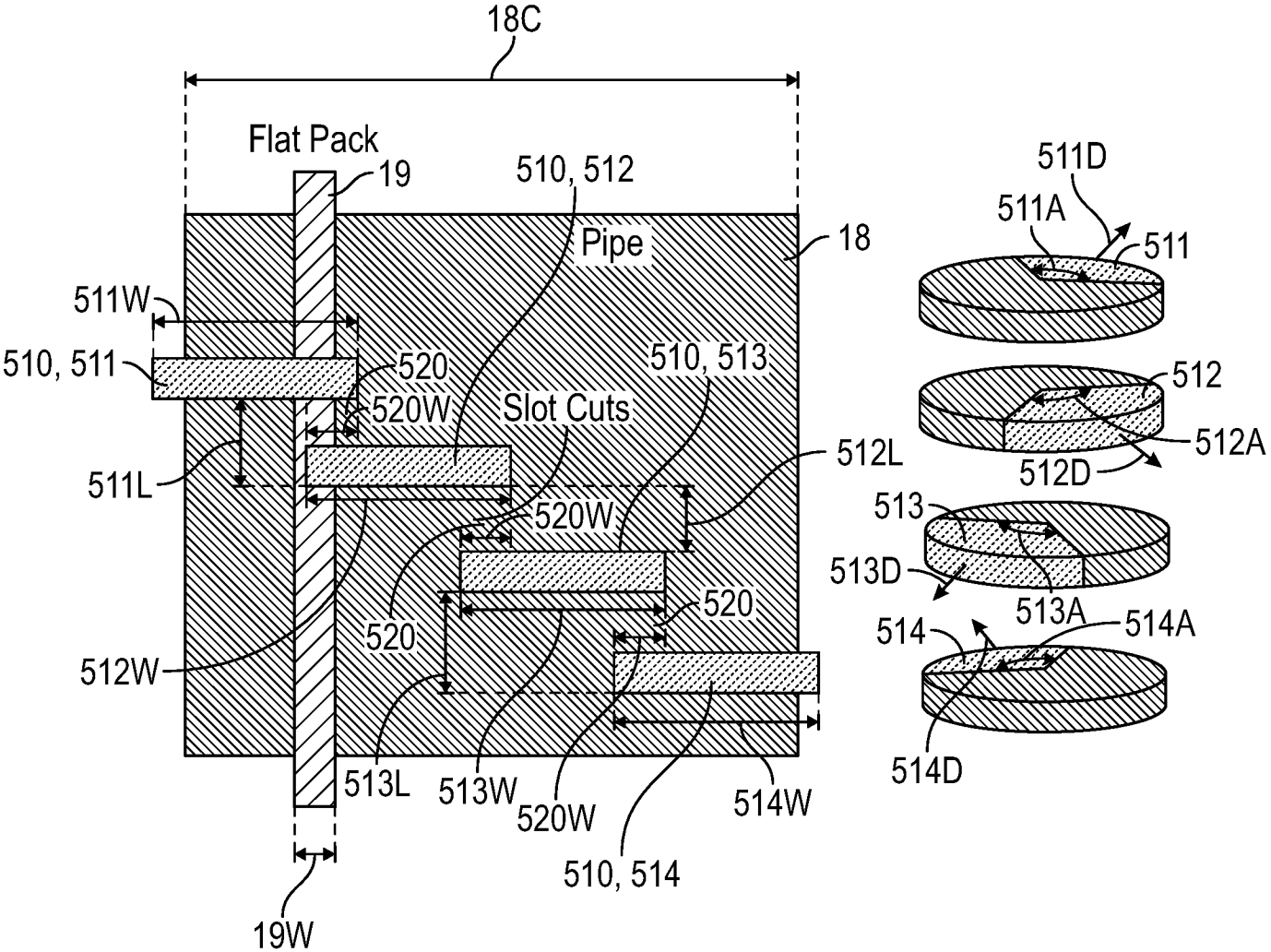
FIG. 5 illustrates a diagram showing an overlap of a round of shots to sever a control line.

FIG. 5 illustrates the shots 110 forming slot cuts 510 lined up in reference to a conduit 18 (e.g., a pipe) and an example control line (e.g., flat pack) 19. The rectangular shape of the conduit 18 in FIG. 5 represents the circumference 18C of the conduit 18. As can be seen in FIG. 5, the slot cuts 510 formed by the shots 110 overlap an overlap width 520 W that is greater than the width 19 W of the control line 19. For example, each shot 110 (e.g., shot 111) of the round 106 of shots 110 in the cutting device 100 overlaps an adjacent shot 110 (e.g., shot 112) by an overlap width 520 W that is equal to or greater than the line width 19 W of the control lines 19 so that any combination of the shot 110 (e.g., 111) and/or the adjacent shot 110 (e.g., 112) fully severs the control lines 19. The width 520 W of the overlap 520 of the shots 110 caused by the overlap of the apex angles 311A, 312A, 313A, 314A must be greater than the width 19 W of the control line(s) 19, so that the control lines 19 are fully severed with one round 106 of shots 110. Accordingly, the control line 19 is fully severed, no matter the position of the control line 19 in relation to the conduit 18.

The apex angle 311A, 312A, 313A, 314A for each shot 110 of the round 106 of shots 110 can overlap the apex angle 311A, 312A, 313A, 314A for the adjacent shot 110 by an overlap angle so that the shot 110 overlaps the adjacent shot 110 by the overlap width 520 W. In the examples where the shots 110 have a radial shape, the overlap angle can be determined by the formula: overlap angle=W/πD*360, where W is the line width 19 W of the control line 19, and D is the diameter 18D (for example, as shown in FIG. 2) of the wellbore conduit 18. The overlap angle as determined above provides an overlap 520 between the shots 110 with an overlap width 520 W such that the overlap width 520 W is equal to or greater than the line width 19 W of the control lines 19. Accordingly, the control lines 19 can be fully severed regardless of the positioning of the control lines 19 in relation to the conduit 18. At any given position, at least one shot 110 alone will sever the control line 19 completely. If multiple control lines 19 are spreaded around the conduit 18 at unknown positions, the combination of adjacent shots 110 of the cutting device 100 assures that all control lines 19 can be fully severed by at least one shot 110.

For example, the conduit 18 may have a diameter of 5.5 inches. The circumference 18C of the conduit 18 is then 17.82 inches. The control line 19 may have a 1.42 inch line width 19 W, which corresponds to about 28.7 degrees about the circumference 18C of the conduit 18. Accordingly, the cutting device 100 can have shots 110 that overlap at least 28 degrees, for example about 30 degrees, so that the shot 110 overlaps the adjacent shot 110 by the overlap width 520 W to ensure that the control line 19 is fully severed by at least one shot 110 regardless of position along the conduit 18. The amount of overlap 520 and/or number of shots 110 can vary based on the diameter 18D of the conduit 18 and/or the width 19 W of the control lines 19.

Figure 6:
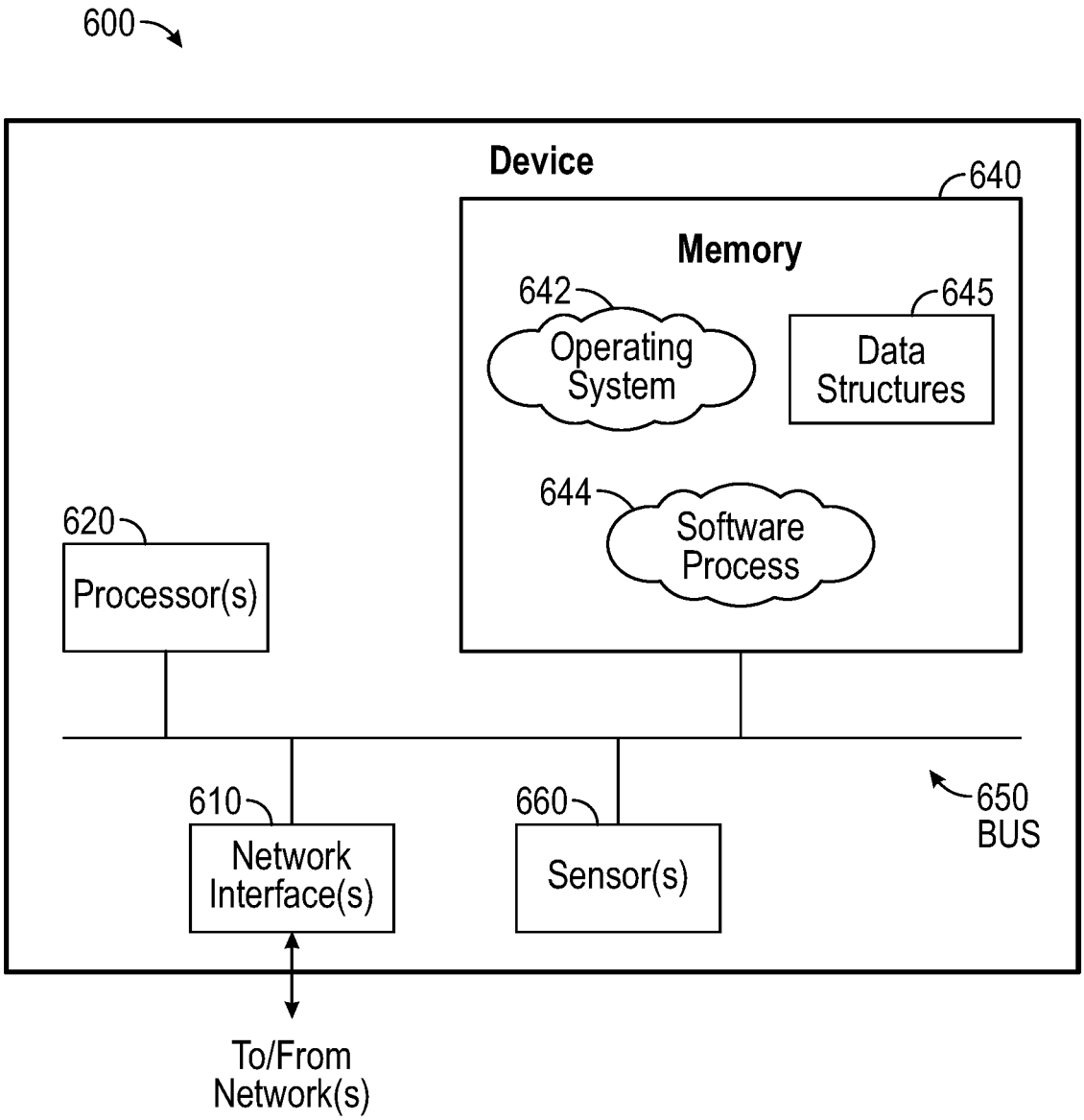
FIG. 6 is a schematic diagram of a controller which may be employed as shown in FIG. 1.

FIG. 6 is a block diagram of an exemplary controller 600. Controller 600 is configured to perform processing of data and communicate with the cutting device 100, for example as illustrated in FIGS. 2-5. In operation, controller 600 communicates with one or more of the above-discussed components and may also be configured to communication with remote devices/systems.

As shown, controller 600 includes hardware and software components such as network interfaces 610, at least one processor 620, sensors 660 and a memory 640 interconnected by a system bus 650. Network interface(s) 610 can include mechanical, electrical, and signaling circuitry for communicating data over communication links, which may include wired or wireless communication links. Network interfaces 610 are configured to transmit and/or receive data using a variety of different communication protocols, as will be understood by those skilled in the art.

Processor 620 represents a digital signal processor (e.g., a microprocessor, a microcontroller, or a fixed-logic processor, etc.) configured to execute instructions or logic to perform tasks in a wellbore environment. Processor 620 may include a general purpose processor, special-purpose processor (where software instructions are incorporated into the processor), a state machine, application specific integrated circuit (ASIC), a programmable gate array (PGA) including a field PGA, an individual component, a distributed group of processors, and the like. Processor 620 typically operates in conjunction with shared or dedicated hardware, including but not limited to, hardware capable of executing software and hardware. For example, processor 620 may include elements or logic adapted to execute software programs and manipulate data structures 645, which may reside in memory 640.

Sensors 660 typically operate in conjunction with processor 620 to perform measurements, and can include special-purpose processors, detectors, transmitters, receivers, and the like. In this fashion, sensors 660 may include hardware/software for generating, transmitting, receiving, detection, logging, and/or sampling magnetic fields, seismic activity, and/or acoustic waves, or other parameters.

Memory 640 comprises a plurality of storage locations that are addressable by processor 620 for storing software programs and data structures 645 associated with the embodiments described herein. An operating system 642, portions of which may be typically resident in memory 640 and executed by processor 620, functionally organizes the device by, inter alia, invoking operations in support of software processes and/or services 644 executing on controller 600. These software processes and/or services 644 may perform processing of data and communication with controller 600, as described herein. Note that while process/service 644 is shown in centralized memory 640, some examples provide for these processes/services to be operated in a distributed computing network.

It will be apparent to those skilled in the art that other processor and memory types, including various computer-readable media, may be used to store and execute program instructions pertaining to the fluidic channel evaluation techniques described herein. Also, while the description illustrates various processes, it is expressly contemplated that various processes may be embodied as modules having portions of the process/service 644 encoded thereon. In this fashion, the program modules may be encoded in one or more tangible computer readable storage media for execution, such as with fixed logic or programmable logic (e.g., software/computer instructions executed by a processor, and any processor may be a programmable processor, programmable digital logic such as field programmable gate arrays or an ASIC that comprises fixed digital logic. In general, any process logic may be embodied in processor 620 or computer readable medium encoded with instructions for execution by processor 620 that, when executed by the processor, are operable to cause the processor to perform the functions described herein.

Numerous examples are provided herein to enhance understanding of the present disclosure. A specific set of statements are provided as follows.

Statement 1: A cutting device comprising: a round of shots operable to perforate through a wellbore conduit to sever one or more control lines, each of the round of shots having a radial shape such that each of the round of shots perforates the wellbore conduit along an apex angle, wherein each shot of the round of shots overlaps an adjacent shot in the round of shots by an overlap width that is equal to or greater than a line width of the one or more control lines so that any combination of the shot and/or the adjacent shot fully severs the one or more control lines.

Statement 2: A cutting device as disclosed in Statement 1, wherein the round of shots includes a first shot, a second shot, a third shot, and a fourth shot such that the first shot is adjacent to the second shot, the second shot is adjacent the third shot, and the third shot is adjacent the fourth shot.

Statement 3: A cutting device as disclosed in Statement 2, wherein the first shot is operable to perforate through the wellbore conduit in a first target direction, the second shot is operable to perforate through the wellbore conduit in a second target direction, the third shot is operable to perforate through the wellbore conduit in a third target direction, and the fourth shot is operable to perforate through the wellbore conduit in a fourth target direction.

Statement 4: A cutting device as disclosed in Statement 2 or 3, wherein the first target direction is about 90 degrees offset from the second target direction, the second target direction is about 90 degrees offset from the third target direction, and the third target direction is about 90 degrees offset from the fourth target direction.

Statement 5: A cutting device as disclosed in Statement 4, wherein the first target direction is about 180 degrees offset from the third target direction, and the second target direction is about 180 degrees offset from the fourth target direction.

Statement 6: A cutting device as disclosed in any of preceding Statements 2-5, wherein the first shot is positioned a first distance from the second shot along a longitudinal direction of the cutting device, the second shot is positioned a second distance from the third shot along the longitudinal direction of the cutting device, and the third shot is positioned a third distance from the fourth shot along the longitudinal direction of the cutting device.

Statement 7: A cutting device as disclosed in any of preceding Statements 2-6, wherein the first shot, the second shot, the third shot, and the fourth shot are each distanced from one another at least a predetermined distance such that the round of shots maintains structural integrity of the wellbore conduit after perforating the wellbore conduit.

Statement 8: A cutting device as disclosed in any of preceding Statements 1-7, wherein each shot in the round of shots is positioned in a spiral configuration along a longitudinal axis of the cutting device.

Statement 9: A cutting device as disclosed in any of preceding Statements 1-8, wherein an apex angle for each shot of the round of shots overlaps an apex angle for the adjacent shot by an overlap angle of at least about 28 degrees so that the shot overlaps the adjacent shot by the overlap width.

Statement 10: A cutting device as disclosed in any of preceding Statements 1-9, wherein the apex angle for each shot of the round of shots overlaps the apex angle for the adjacent shot by an overlap angle so that the shot overlaps the adjacent shot by the overlap width, wherein the overlap angle is determined by the formula:

$$\text{overlap angle} = \frac{W}{\pi D} * 360,$$

where W is the line width of the control line, and D is the diameter of the wellbore conduit.

Statement 11: A cutting assembly comprising: a cutting device including a round of shots operable to perforate through a wellbore conduit to sever one or more control lines, each of the round of shots having a radial shape such that each of the round of shots perforates the wellbore conduit along an apex angle; and a cutting conduit coupled with the cutting device, the cutting conduit communicably coupled with a trigger operable to activate each of the round of shots; wherein each shot of the round of shots overlaps an adjacent shot in the round of shots by an overlap width that is equal to or greater than a line width of the one or more control lines so that any combination of the shot and/or the adjacent shot fully severs the one or more control lines.

Statement 12: A cutting assembly as disclosed in Statement 11, wherein the round of shots includes a first shot, a second shot, a third shot, and a fourth shot such that the first shot is adjacent to the second shot, the second shot is adjacent the third shot, and the third shot is adjacent the fourth shot.

Statement 13: A cutting assembly as disclosed in Statement 12, wherein the first shot is operable to perforate through the wellbore conduit in a first target direction, the second shot is operable to perforate through the wellbore conduit in a second target direction, the third shot is operable to perforate through the wellbore conduit in a third target direction, and the fourth shot is operable to perforate through the wellbore conduit in a fourth target direction.

Statement 14: A cutting assembly as disclosed in Statements 12 or 13, wherein the first target direction is about 90 degrees offset from the second target direction, the second target direction is about 90 degrees offset from the third target direction, and the third target direction is about 90 degrees offset from the fourth target direction.

Statement 15: A cutting assembly as disclosed in Statement 14, wherein the first target direction is about 180 degrees offset from the third target direction, and the second target direction is about 180 degrees offset from the fourth target direction.

Statement 16: A cutting assembly as disclosed in any of preceding Statements 12-15, wherein the first shot, the second shot, the third shot, and the fourth shot are each distanced from one another at least a predetermined distance along a longitudinal axis such that the round of shots maintains structural integrity of the wellbore conduit after perforating the wellbore conduit.

Statement 17: A cutting assembly as disclosed in any of preceding Statements 11-16, wherein each shot in the round of shots is positioned in a spiral configuration along a longitudinal axis of the cutting device.

Statement 18: A cutting assembly as disclosed in any of preceding Statements 11-17, wherein the apex angle for each shot of the round of shots overlaps the apex angle for the adjacent shot by an overlap angle so that the shot overlaps the adjacent shot by the overlap width, wherein the overlap angle is determined by the formula:

$$\text{overlap angle} = \frac{W}{\pi D} * 360,$$

where W is the line width of the control line, and D is the diameter of the wellbore conduit.

Statement 19: A cutting assembly as disclosed in any of preceding Statements 11-18, wherein the cutting conduit includes a wireline, and the trigger includes an electrical trigger.

Statement 20: A cutting assembly as disclosed in any of preceding Statements 11-19, further comprising a second round of shots positioned down a distance from the round of shots along a longitudinal axis, wherein the round of shots and the second round of shots are operable to be activated independently.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A cutting device comprising:

a round of shots operable to perforate through a wellbore conduit to sever one or more control lines, each of the round of shots having a radial shape such that each of the round of shots perforates the wellbore conduit along an apex angle, wherein each shot of the round of shots overlaps an adjacent shot in the round of shots by an overlap width that is equal to or greater than a line width of the one or more control lines so that any combination of the shot and/or the adjacent shot fully severs the one or more control lines, and wherein an apex angle for each shot of the round of shots overlaps an apex angle for the adjacent shot by an overlap angle of at least about 28 degrees so that the shot overlaps the adjacent shot by the overlap width.

2. The cutting device of claim 1, wherein the round of shots includes a first shot, a second shot, a third shot, and a fourth shot such that the first shot is adjacent to the second shot, the second shot is adjacent the third shot, and the third shot is adjacent the fourth shot.

3. The cutting device of claim 2, wherein the first shot is operable to perforate through the wellbore conduit in a first target direction, the second shot is operable to perforate through the wellbore conduit in a second target direction, the third shot is operable to perforate through the wellbore conduit in a third target direction, and the fourth shot is operable to perforate through the wellbore conduit in a fourth target direction.

4. The cutting device of claim 3, wherein the first target direction is about 90 degrees offset from the second target direction, the second target direction is about 90 degrees offset from the third target direction, and the third target direction is about 90 degrees offset from the fourth target direction.

5. The cutting device of claim 4, wherein the first target direction is about 180 degrees offset from the third target direction, and the second target direction is about 180 degrees offset from the fourth target direction.

6. The cutting device of claim 2, wherein the first shot is positioned a first distance from the second shot along a longitudinal direction of the cutting device, the second shot is positioned a second distance from the third shot along the longitudinal direction of the cutting device, and the third shot is positioned a third distance from the fourth shot along the longitudinal direction of the cutting device.

7. The cutting device of claim 2, wherein the first shot, the second shot, the third shot, and the fourth shot are each distanced from one another at least a predetermined distance such that the round of shots maintains structural integrity of the wellbore conduit after perforating the wellbore conduit.

8. The cutting device of claim 1, wherein each shot in the round of shots is positioned in a spiral configuration along a longitudinal axis of the cutting device.

9. The cutting device of claim 1, wherein the overlap angle is increased based on the line width of the control line and a diameter of the wellbore conduit, wherein the overlap angle is determined by the formula:

$$\text{overlap angle} = \frac{W}{\pi D} * 360,$$

where W is the line width of the control line, and D is the diameter of the wellbore conduit.

10. A cutting assembly comprising:

a cutting device including a round of shots operable to perforate through a wellbore conduit to sever one or more control lines, each of the round of shots having a radial shape such that each of the round of shots perforates the wellbore conduit along an apex angle; and a cutting conduit coupled with the cutting device, the cutting conduit communicably coupled with a trigger operable to activate each of the round of shots;

wherein each shot of the round of shots overlaps an adjacent shot in the round of shots by an overlap width that is equal to or greater than a line width of the one or more control lines so that any combination of the shot and/or the adjacent shot fully severs the one or more control lines, wherein an apex angle for each shot of the round of shots overlaps an apex angle for the adjacent shot by an overlap angle of at least about 28 degrees so that the shot overlaps the adjacent shot by the overlap width.

11. The cutting assembly of claim 10, wherein the round of shots includes a first shot, a second shot, a third shot, and a fourth shot such that the first shot is adjacent to the second shot, the second shot is adjacent the third shot, and the third shot is adjacent the fourth shot.

12. The cutting assembly of claim 11, wherein the first shot is operable to perforate through the wellbore conduit in a first target direction, the second shot is operable to perforate through the wellbore conduit in a second target direction, the third shot is operable to perforate through the wellbore conduit in a third target direction, and the fourth shot is operable to perforate through the wellbore conduit in a fourth target direction.

13. The cutting assembly of claim 12, wherein the first target direction is about 90 degrees offset from the second target direction, the second target direction is about 90 degrees offset from the third target direction, and the third target direction is about 90 degrees offset from the fourth target direction.

14. The cutting assembly of claim 13, wherein the first target direction is about 180 degrees offset from the third target direction, and the second target direction is about 180 degrees offset from the fourth target direction.

15. The cutting assembly of claim 11, wherein the first shot, the second shot, the third shot, and the fourth shot are each distanced from one another at least a predetermined distance along a longitudinal axis such that the round of shots maintains structural integrity of the wellbore conduit after perforating the wellbore conduit.

16. The cutting assembly of claim 10, wherein each shot in the round of shots is positioned in a spiral configuration along a longitudinal axis of the cutting device.

17. The cutting assembly of claim 10, wherein the overlap angle is increased based on the line width of the control line and a diameter of the wellbore conduit, wherein the overlap angle is determined by the formula:

$$\text{overlap angle} = \frac{W}{\pi D} * 360,$$

where W is the line width of the control line, and D is the diameter of the wellbore conduit.

18. The cutting assembly of claim 10, wherein the cutting conduit includes a wireline, and the trigger includes an electrical trigger.

19. The cutting assembly of claim 10, further comprising a second round of shots positioned down a distance from the round of shots along a longitudinal axis, wherein the round of shots and the second round of shots are operable to be activated independently.

* * * * *